US007189001B2

(12) United States Patent
Gerrits

(10) Patent No.: US 7,189,001 B2
(45) Date of Patent: Mar. 13, 2007

(54) LIQUID TIGHT LOCKING ARRANGEMENT WITH SEALING FINGERS

(75) Inventor: Robert P. Gerrits, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 537 days.

(21) Appl. No.: 10/746,435

(22) Filed: Dec. 23, 2003

(65) Prior Publication Data

US 2004/0136617 A1 Jul. 15, 2004

Related U.S. Application Data

(60) Provisional application No. 60/437,699, filed on Jan. 2, 2003.

(51) Int. Cl.
*B65D 33/16* (2006.01)

(52) U.S. Cl. ..... 383/63; 383/59

(58) Field of Classification Search ..... 383/63–64, 383/59; 24/585.12, 585.1, 584.1, 586.1
See application file for complete search history.

(56) References Cited

U.S. PATENT DOCUMENTS

| | | | | |
|---|---|---|---|---|
| 2,144,755 | A * | 1/1939 | Freedman | 24/594.11 |
| 3,372,442 | A | 3/1968 | Ishimatsu | |
| 3,425,469 | A | 2/1969 | Ausnit | |
| 3,565,147 | A | 2/1971 | Ausnit | |
| 4,558,286 | A | 12/1985 | Neidorff | |
| 4,787,755 | A | 11/1988 | Branson | |
| 4,819,309 | A | 4/1989 | Behymer | |
| 5,020,194 | A | 6/1991 | Herringon et al. | |
| 5,588,622 | A | 12/1996 | Gordon, Sr. | |
| 5,689,866 | A | 11/1997 | Kasai et al. | |
| 5,718,024 | A | 2/1998 | Robbins | |
| 5,729,876 | A | 3/1998 | Johnson | |
| 5,988,880 | A | 11/1999 | Tomic | |
| 5,991,980 | A | 11/1999 | Meager | |
| 6,004,032 | A | 12/1999 | Kapperman et al. | |
| 6,009,603 | A | 1/2000 | Gallagher | |
| 6,047,450 | A | 4/2000 | Machacek et al. | |
| 6,152,600 | A | 11/2000 | Tomic | |
| 6,182,337 | B1 | 2/2001 | Machacek et al. | |
| 6,185,796 | B1 * | 2/2001 | Ausnit | 24/585.1 |
| 6,217,215 | B1 | 4/2001 | Tomic | |
| 6,367,128 | B1 * | 4/2002 | Galkiewicz et al. | 24/585.1 |

(Continued)

FOREIGN PATENT DOCUMENTS

| | | | |
|---|---|---|---|
| JP | 2001286308 | A | 10/2001 |

*Primary Examiner*—Jes F. Pascua
(74) *Attorney, Agent, or Firm*—Merchant & Gould P.C.

(57) ABSTRACT

A resealable package includes first and second panel sections joined together to define an enclosed region, first and second opposite side edges, a bottom edge, and a mouth that provides access to the enclosed region. The resealable package also includes a closure mechanism for selectively opening and sealing the mouth. The closure mechanism includes first and second profiles having first and second base strips with first and second interlocking closure members extending from the first and second base strips. The first and second closure profiles also include third and fourth interlocking members extending from third and fourth base strips, the third interlocking member having a first sealing member projecting therefrom. The second closure profile further includes a second sealing member extending from a fifth base strip. The first and second sealing members engage to form a liquid-tight seal.

17 Claims, 3 Drawing Sheets

U.S. PATENT DOCUMENTS 6,609,827 B2 * 8/2003 Bois et al. ..... 383/63
7,052,181 B2 * 5/2006 Smith et al. ..... 383/64
2002/0114540 A1 8/2002 Shimizu
2003/0223654 A1 * 12/2003 Gerrits ..... 383/63

* cited by examiner

LIQUID TIGHT LOCKING ARRANGEMENT WITH SEALING FINGERS

CROSS-REFERENCE TO RELATED APPLICATION

The present application is based on and claims priority to U.S. Provisional Patent Application Ser. No. 60/437,699, filed Jan. 2, 2003.

FIELD OF THE INVENTION

The present invention relates generally to a method of producing a closure mechanisms for use with polymer packages, for example, plastic bags. In particular, the present invention relates to closure mechanisms having a liquid tight sealing arrangement.

BACKGROUND OF THE INVENTION

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Resealable packages typically utilize a closure mechanism that is positioned along the mouth of the package. The closure mechanism often comprises profile elements or closure profiles that engage one another when pressed together and disengage when pulled apart. The profile elements are often designed to disengage with the use of minimal force, to allow the package to be easily opened. However, this can cause the profile elements to disengage as the package is moved or placed in storage, because the profile elements can be jostled during such movement. Because a small force is all that is typically required to disengage the profile elements, the elements may become disengaged even when it is undesired. This is a significant concern when the product is a liquid or a small solid that can leak through even the smallest opening in the package. It is therefore desirable to provide a closure mechanism, such as disclosed in applicant's pending U.S. patent application Ser. No. 10/159,618 filed May 31, 2002, that can be fully sealed and will remain sealed in order to prevent product leakage.

SUMMARY OF THE INVENTION

In an embodiment of the present invention, a liquid tight closure mechanism is provided comprising first and second closure profiles, the first closure profile comprising a first base strip having a first interlocking member extending therefrom and the second closure profile comprising a second base strip having a second interlocking member extending therefrom. The first closure profile further comprises a third base strip having a third interlocking member extending therefrom, the third interlocking member having a first sealing member projecting therefrom. The second closure profile further comprises a fourth base strip with a fourth interlocking member extending therefrom. The first, second, third and fourth interlocking members are constructed and arranged to selectively interlock. The second closure profile further comprises a fifth base strip with a second sealing member projecting therefrom. A distal end of the first sealing member is designed and arranged to selectively engage a distal end of the second sealing member to provide a liquid tight seal.

In another embodiment of the present invention, a resealable package includes first and second panel sections joined together to define an enclosed region, first and second panel sections joined together to define an enclosed region, first and second opposite side edges, a bottom edge, and a mouth that provides access to the enclosed region. The resealable package also includes a liquid tight closure mechanism for selectively opening and sealing the mouth. The closure mechanism includes structure as previously described herein. The resealable package further includes sealing structure as previously described wherein the first sealing member is designed and arranged to selectively engage an inside surface of the fifth base strip and the second sealing member to provide a liquid tight seal.

BRIEF DESCRIPTION OF THE DRAWINGS

The various features and benefits of the present invention are apparent in light of the following detailed description and the accompanying drawings, in which.

DETAILED DESCRIPTION OF PREFERRED EMBODIMENTS

Figure 1:
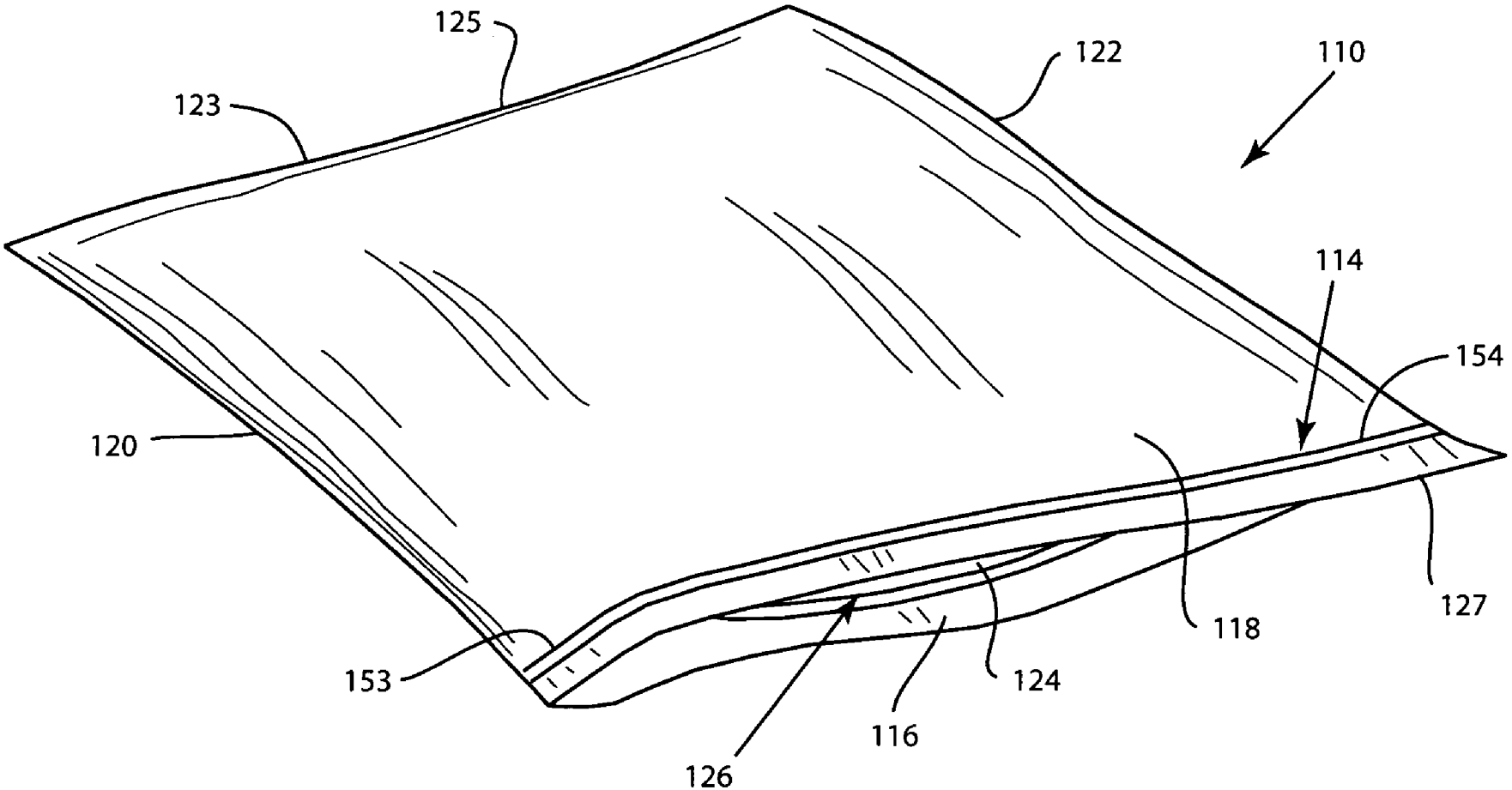
FIG. 1 is a perspective view of a flexible, resealable package in accordance with an embodiment of the present invention.

FIG. 1 illustrates an example packaging arrangement in the form of a resealable, flexible package 110, for example, a polymeric package such as a plastic bag, having a resealable locking profile or closure mechanism 114, for example, interlocking profile elements, constructed in accordance with the present invention. The flexible package 110 includes first and second opposed panel sections 116, 118, typically made from a flexible, polymeric, plastic film, such as a low density polyethylene.

With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package.

In the particular embodiment illustrated in FIG. 1, the mouth 126 extends the width of the package 110. The resealable closure mechanism 114 is illustrated at the mouth 126 of the flexible package 110. Preferably, the cross-section of the closure mechanism 114 is continuous along its length across the mouth 126 of the package 110. Alternatively, the closure mechanism 114 could be positioned on the package 110 at a location different from the mouth 126 of the package 110, depending on the application needs for the package 110.

Figure 2:
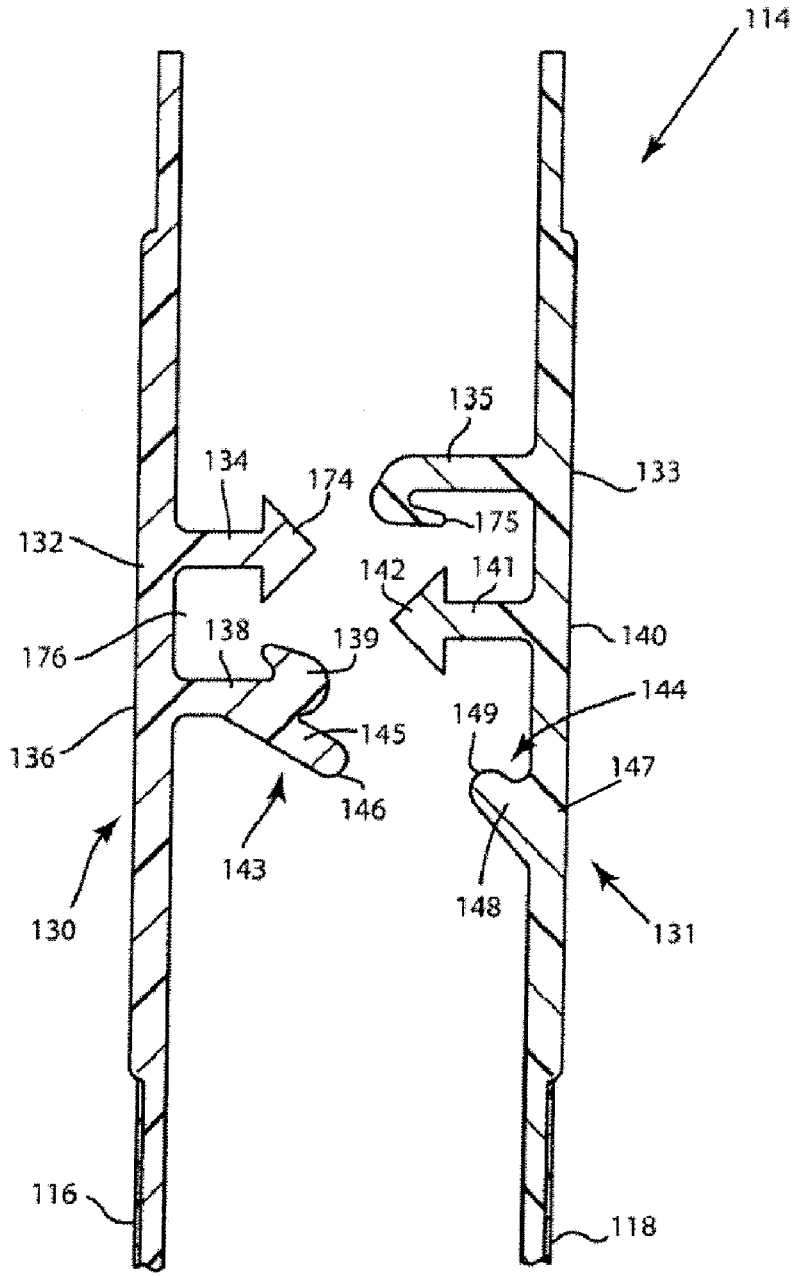
FIG. 2 is an enlarged, fragmented, cross-sectional view of a liquid-tight closure mechanism according to an example embodiment of the present invention.

In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that, under the application of pressure, will interlock and close the region between the profiles.

In the embodiment shown in FIG. 2, the resealable closure mechanism 114 comprises first and second closure profiles 130, 131. The first and second closure profiles 130, 131 are connected to the two panel sections 116, 118, respectively. The first and second closure profiles 130, 131 may be attached to the panel sections 116, 118 by any appropriate means known to those skilled in the art. For example, the first and second closure profiles 130, 131 may be formed separately, then heat sealed to the panel sections 116, 118.

As shown in FIG. 2, the first closure profile 130 includes a first base strip 132 with an interlocking member 134 extending therefrom. At a free end or tip of the interlocking member 134 is an arrowhead or catch 174. Although the catch 174 is shown extending bi-directionally from the interlocking member 134, it is contemplated that the catch could extend only toward the open interior of the package. Likewise, the second closure profile 131 includes a second base strip 133 and an interlocking member 135 extending therefrom. At a free end or tip of the interlocking member 135 is a hook or catch 175.

The first closure profile 130 includes a lower third base strip 136 with an interlocking member 138 extending therefrom. At a free upper end or tip of the interlocking member 138 is a nib or third catch 139 disposed thereon. The interlocking members 134 and 138 define a receiving cavity 176. Likewise, the second closure profile 131 includes a fourth base strip 140 with an interlocking member 141 extending therefrom. The interlocking member 141 has a free end or tip provided with another arrowhead or catch 142.

Figure 3:
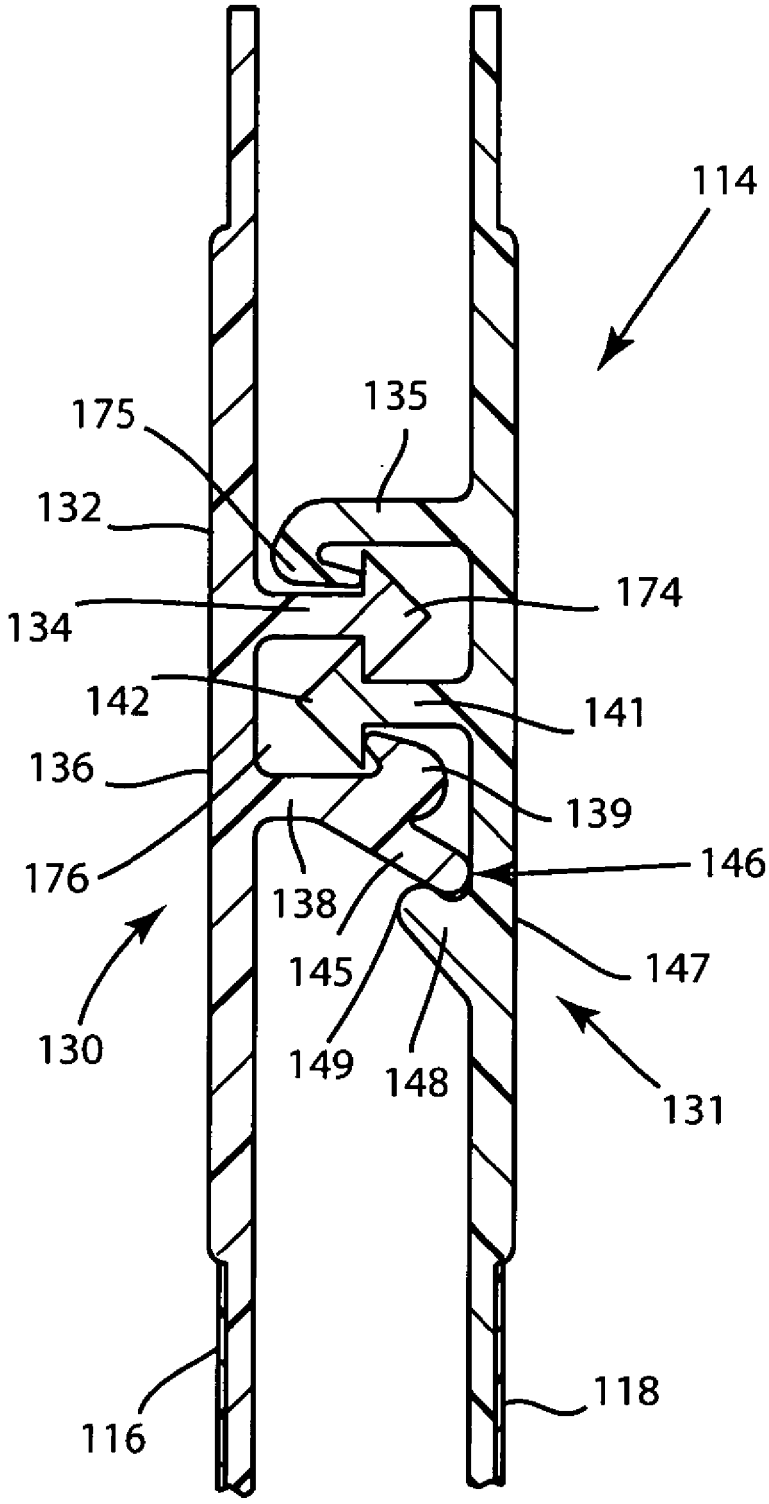
FIG. 3 is an enlarged, fragmented, cross-sectional view of the liquid-tight closure mechanism illustrated in FIG. 2, shown in the closed position.

The first and second closure profiles 130, 131 are designed and constructed to engage with one another to form a liquid tight resealable closure mechanism 114. The interlocking member 134 of the first closure profile 130 extends from the first base strip 132 an engagement distance. The interlocking member 135 of the second closure profile 131 also extends from the second base strip 133 an engagement distance. The interlocking member 138 extends from the third base strip 136 an engagement distance. Likewise, the interlocking member 141 extends from the fourth base strip 140 an engagement distance. These engagement distances that the interlocking members 134, 135, 138, 141, respectively, extend are sufficient to allow mechanical engagement, or interlocking, between the interlocking member 134 and the interlocking member 135, between the interlocking member 134 and the interlocking member 141 and between the interlocking member 138 and the interlocking member 141 as shown in FIG. 3.

In particular, the catch 174 of the interlocking member 134 engages with the catch 175 of the interlocking member 135. In addition, the interlocking member 141 is received within the cavity 176 such that the catch 174 engages with the catch 142 and the catch 139 engages with the catch 142. Furthermore, the closure profiles 130, 131 remain sealed together at their ends, for example, as shown in FIG. 1, as first and second regions 153, 154 to further aid in aligning the remainder of closure profiles 130, 131 for interlocking. Pressure is applied to the closure profiles 130, 131 as they engage to form the re-openable sealed closure mechanism 114. Pulling the first closure profile 130 and the second closure profile 131 away from each other causes the two closure profiles 130, 131 to disengage.

As stated above, as closure mechanisms are typically designed to easily disengage, some have the tendency to disengage even when it is undesired. This is especially troublesome when the product stored inside of the package 110 is a liquid that can escape through small openings in the closure mechanism 114. Therefore, the liquid tight closure mechanism 114 of the present invention also includes first and second sealing members 143, 144.

Formed integrally with and extending downwardly and away from the interlocking member 138 beneath nib 139 is a first sealing finger 145 having a distal end 146 disposed an engagement distance from the third base strip 136. The second closure profile 131 includes a fifth base strip 147 with a second sealing finger 148 extending upwardly and away therefrom. The second sealing finger 148 is located beneath the first sealing finger 145 and has a distal end 149 disposed an engagement distance from the fifth base strip 147. These engagement distances for the distal ends 146, 149 are sufficient to allow mechanical engagement, or wedging, between first and second sealing fingers 145, 148.

With further reference to FIG. 3, pressure is applied to the closure profiles 130, 131 as they engage to form sealed closure mechanism 114. As this occurs, the distal end 146 on the first sealing finger 145 engages an inside surface of the fifth base strip 147 and the distal end 149 on the second sealing finger 148 to form a liquid-tight seal when the closure mechanism 114 is sealed. The liquid-tight seal prevents any of a liquid product placed in package 110 from escaping the package 110 through the closure mechanism 114. The first sealing finger 145 and the second sealing finger 148 are configured so that when they are engaged, the force required to disengage them is greater than the force required to disengage the interlocking members 134, 135, 138, 141. In this way, the first and second sealing members 143, 144 also help prevent the closure mechanism 114 from unintended opening, for example, during transport.

While specific embodiments and methods for practicing this invention have been described in detail, those skilled in the art will recognize various manifestations and details that could be developed in light of the overall teachings herein. Specifically, a variety of interlocking closure member designs are known in the art. While several specific embodiments have been illustrated and described in detail, any appropriate interlocking closure members may be used with the sealing members described herein to form the liquid tight closure mechanism of the present invention. Accordingly, the particular mechanisms disclosed are meant to be illustrative only and not to limit the scope of the invention which is to be given the full breadth of the following claims and any and all embodiments thereof.

Having described the presently preferred embodiments, it is to be understood that the invention may be otherwise embodied within the scope of the appended claims.

What is claimed is:

1. A resealable flexible package comprising:

(a) first and second panel sections joined together to define an enclosed region, first and second opposite side edges, a bottom and a mouth that provides access to the enclosed region;

(b) a closure mechanism comprising first and second closure profiles;

(i) the first closure profile comprising a base strip, the base strip having a first interlocking member and a second interlocking member extending therefrom, the second interlocking member having a first sealing finger projecting therefrom;

(ii) the second closure profile including a base strip, the base strip having an interlocking member extending therefrom;

(iii) the first and second interlocking members formed on the first closure profile being constructed and arranged to selectively interlock with the interlocking member formed on the second closure profile;

(iv) the second closure profile further comprising a second sealing finger projecting therefrom; and (v) wherein the first sealing finger is designed and arranged to selectively engage an inside surface of the base strip of the second closure profile and the second sealing finger to provide a liquid tight seal wherein the first interlocking member of the first closure profile includes an arrowhead.

2. The package of claim 1, wherein the interlocking member formed on the second closure profile includes an arrowhead.

3. The package of claim 1, wherein the first sealing finger extends below the first closure profile.

4. The package of claim 3, wherein the second sealing finger is disposed beneath the first sealing finger.

5. The package of claim 4, wherein the second interlocking member formed on the first closure profile includes an interlocking nib.

6. The package of claim 5, wherein the first sealing finger is disposed beneath the nib.

7. The package of claim 6, wherein the first sealing finger projects downwardly and away from the nib.

8. The package of claim 6, wherein the second sealing finger projects upwardly and away from the base strip of the second closure profile.

9. A closure mechanism comprising:

(a) first and second closure profiles;

(b) the first closure profile comprising a first base strip, the first base strip having a first interlocking member extending therefrom;

(c) the second closure profile comprising a second base strip, the second base strip having a second interlocking member extending therefrom;

(d) the first closure profile further comprising a third base strip having a third interlocking member extending therefrom, the third interlocking member having a first sealing finger projecting thereon;

(e) the second closure profile further comprising a fourth base strip with a fourth interlocking member extending therefrom;

(f) the first, second, third and fourth interlocking members constructed and arranged to selectively interlock together;

(g) the second closure profile further comprising a fifth base strip with a second sealing finger projecting therefrom; and (h) wherein a distal end of the first sealing finger is designed and arranged to selectively engage a distal end of the second sealing finger to provide a liquid tight seal wherein the first interlocking member includes an arrowhead.

10. The closure mechanism of claim 9, wherein the second interlocking member includes a hook.

11. The closure mechanism of claim 9, wherein the third interlocking member includes a nib.

12. The closure mechanism of claim 11, wherein the first sealing finger extends below the first closure profile.

13. The closure mechanism of claim 12, wherein the second sealing finger is disposed beneath the first finger.

14. The closure mechanism of claim 12, wherein the first sealing finger is disposed beneath the nib.

15. The closure mechanism of claim 14, wherein the first sealing finger projects downwardy and away from the nib.

16. The closure mechanism of claim 13, wherein the second sealing finger projects upwardly and away from the fifth base strip.

17. The closure mechanism of claim 9, wherein the fourth interlocking member includes an arrowhead.

* * * * *